US006764645B2

(12) United States Patent
Hayaishi et al.

(10) Patent No.: US 6,764,645 B2
(45) **Date of Patent: *Jul. 20, 2004**

(54) STEEL FOR MACHINE STRUCTURAL USE HAVING GOOD MACHINABILITY AND CHIP-BREAKABILITY

(75) Inventors: Masakazu Hayaishi, Nagoya (JP); Takashi Kano, Nagoya (JP); Kazuhisa Ishida, Nagoya (JP); Yutaka Kurebayashi, Nagoya (JP); Makoto Hobo, Nagoya (JP)

(73) Assignee: Diado Steel Co., Ltd., Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/305,064

(22) Filed: Nov. 27, 2002

(65) Prior Publication Data

US 2003/0178105 A1 Sep. 25, 2003

(30) Foreign Application Priority Data

Nov. 28, 2001 (JP) ..... 2001-362733
Apr. 22, 2002 (JP) ..... 2002-119677
Sep. 2, 2002 (JP) ..... 2002-256778

(51) Int. Cl.[7] ..... C22C 38/14

(52) U.S. Cl. ..... 420/125; 420/126; 148/622; 148/625

(58) Field of Search ..... 420/125, 126, 420/83; 148/622, 625

(56) References Cited

U.S. PATENT DOCUMENTS 3,857,740 A * 12/1974 Gondo et al. ..... 148/12 F
3,973,950 A * 8/1976 Itoh et al. ..... 75/123 D
4,746,361 A * 5/1988 Pielet et al. ..... 75/53
4,842,816 A * 6/1989 Miyasaka et al. ..... 420/84
6,200,527 B1 * 3/2001 Damie et al. ..... 420/84
6,596,227 B2 * 7/2003 Shindo et al. ..... 420/84

* cited by examiner

*Primary Examiner*—Daniel Jenkins
(74) *Attorney, Agent, or Firm*—Varndell & Varndell, PLLC

(57) ABSTRACT

Disclosed is a steel for machine structural use having good machinability and chip-breakability as well as a method of producing the steel. The steel consists essentially of, by wt. %, C: 0.05–0.8%, Si: 0.01–2.0%, Mn: 0.1–3.5%, S: 0.01–0.2%, Al: 0.001–0.020%, Ca: 0.0005–0.02%, O: 0.0005–0.01% and N: 0.001–0.04%, and further, one or both of Ti: 0.002–0.010% and Zr: 0.002–0.025%, the balance being Fe and inevitable impurities. At production of the steel controlled deoxidization is conducted by operation meeting certain conditions so that at least a certain amount of "duplex inclusion" having a specific chemical composition may be formed, and Ti and/or Zr is added to precipitate finely dispersed MnS inclusion particles with nuclei of Ti-oxide and/or Zr-oxide. The finely dispersed MnS inclusions must share a determined part of the total sulfide inclusions.

9 Claims, 5 Drawing Sheets

STEEL FOR MACHINE STRUCTURAL USE HAVING GOOD MACHINABILITY AND CHIP-BREAKABILITY

BACKGROUND OF THE INVENTION

The present invention concerns a steel for machine structural use having good machinability and good chip-breakability in cutting by cemented carbide tools, as well as a method of producing the steel. The invention also concerns a steel for machine structural use exhibiting high fatigue strength and bend-straightenability in addition to the good machinability and chip-breakability.

In the present invention the term "duplex inclusion" means an inclusion of the structure in which a core mainly consisting of oxide inclusion is surrounded by another inclusion consisting mainly of sulfides. The terms "tool life ratio" and "life ratio" mean a ratio of tool life of the free-cutting steel according to the invention to tool life of the conventional sulfur free-cutting steel containing the same S-contents in turning with a cemented carbide tool. "Finely dispersed" MnS inclusion particles are the particles finer than those in the conventional MnS inclusions particles contained in the conventional steel and existing in the form of uniform distribution in the steel matrix without coagulation or concentration.

Research and development on steel for machine structural use having high machinability have been made for many years, and the applicant has made many proposals. In recent years Japanese patent disclosure No. 10-287953 bearing the title of "Steel for machine structural use having good mechanical properties and drilling machinability" is mentioned as one of the representative technologies. The free-cutting steel of this invention is characterized by calcium-manganese sulfide inclusion containing 1% or more of Ca in a spindle shape with an aspect ratio (length/width) up to 5, which envelopes a core of calcium aluminate containing 8–62% of CaO. Though the steel exhibited excellent machinability, dispersion of the machinability has been sometimes experienced. This was considered to be due to variety of types of the above-mentioned calcium-manganese sulfide inclusion.

The applicant disclosed in Japanese patent disclosure No. 2000-34534 "Steel for machine structural use having good machinability in turning" that, with classification of Ca-containing sulfide inclusions into three groups by Ca-contents observed as the area percentages in microscopic field, A: Ca-content more than 40%, B: Ca-content 0.3–40%, and C: Ca-content less than 0.3%, a steel satisfying the conditions, $A/(A+B+C) \leqq 0.3$ and $B/(A+B+C) \geqq 0.1$, exhibits very prolonged tool life in turning.

Further research by the applicant succeeded, as disclosed in Japanese patent disclosure No. 2000-219936 "Free-cutting steel", in decreasing the dispersion of the machinability by clarifying necessary number of inclusion particles in the steel. The steel of this invention is characterized in that it contains five or more particles per 3.3 $mm^2$ of equivalent diameter 5 $\mu$m or more of sulfide inclusion containing 0.1–1.0% of Ca. There was, however, still some room for improving the dispersion of the machinability.

Then the applicant developed a steel for machine structural use having improved dispersion of the machinability, with so high machinability in cutting by a cemented carbide tools that fivefold or more of tool life ratio is achieved, and proposed it (Japanese patent application No. 2001-174606 "Free-cutting steel having good machinability in cutting with a cemented carbide"). The free-cutting steel is characterized by the state of the inclusions. The characteristic feature of the steel is the above-mentioned "duplex inclusion", i.e., the inclusion of the structure in which "sulfide inclusion particles containing Ca of 1.0 wt. % or more and neighboring to oxide inclusion particles containing CaO of 8–62 wt. %" exists at least a certain amount, specifically, "that the area occupied by the sulfide inclusion is $2.0\times10^{-4}$ $mm^2$ per 3.5 $mm^2$ or more in microscopic field".

In the patent application there has been disclosed that in a method for producing the free-cutting steel containing the above mentioned duplex inclusions it is essential to carry out the operation satisfying the conditions below at preparation of the steel:

[S]/[O]: 8–40,
[Ca]×[S]: $1\times10^{-5-1\times10-3}$
[Ca]/[S]: 0.01–20, and
[Al]: 0.001–0.020%.

Based on the recent results of research the applicants developed a free-cutting steel having not only a long tool life but also good chip-breakability, and therefore, suitable for being processed with automated machining. This free-cutting steel is already proposed (Japanese patent application No. 2001-362733). The free-cutting steel consists essentially of, as the basic alloy composition, by wt. %, C: 0.05–0.8%, Si: 0.01–2.5%, Mn: 0.1–3.5%, S: 0.01–0.2%, Al: 0.001–0.020%, Ca: 0.0005–0.02%, O: 0.0005–0.01% and N: 0.001–0.04%, and further, one or both of Ti: 0.002–0.010% and Zr: 0.002–0.025%, the balance being Fe and inevitable impurities, and is characterized in that the area occupied by the sulfide inclusion particles containing Ca of 1.0 wt. % or more and neighboring to oxide inclusion particles containing CaO of 0.2–62 wt. % is $2.0\times10^{-4}$ $mm^2$ per 3.5 $mm^2$ or more of microscopic field and that the above MnS inclusion particles are finely dispersed in the steel.

Novel features of this invention in comparison with the previous invention are, in one hand, extended lower limit of CaO-content of the oxide inclusion particles which form the duplex inclusion, and on the other hand, a more important difference that "the MnS inclusions are finely dispersed". The latter feature brings about the improved chip-breakability, and as the result, realizes suitable balance of the tool life and the chip-breakability. The former feature, fine dispersion of the MnS inclusions can be given by addition of a certain amount or amounts of Ti and/or Zr to form fine Ti-oxide, Zr-oxide or (Ti+Zr)-oxide to have MnS precipitated on the oxide nuclei. These oxides may include manganese oxide, and thus, in that case, they may be $TiO_2$—$MnO_2$, $ZrO_2$—$MnO_2$ or $TiO_2$—$ZrO_2$—$MnO_2$.

The free-cutting steel covers various kinds of steel classified in the steel for machine structural use. It has been found that, in the process of establishing concrete alloy compositions in the applicable fields, the invention is useful even in the relatively high S-content range. In other words, it has been revealed that, of the operation conditions mentioned above, the upper limit of [S]/[O]: 8–40 can be increased to 80 or so. On the other hand, after wide-ranged experiments, some dispersion in the balance of the tool life and the chip-breakability was still observed.

SUMMARY OF THE INVENTION

The object of the present invention is to add further improvements to the free-cutting steel for machine structural use having improved dispersion of the machinability by utilizing the above described duplex inclusion to enable such improvement in machinability as fivefold or more tool life and good chip-breakability, and thus, to provide a steel in which better chip-breakability can be always obtained and is suitable for machining, particularly, turning. To provide a free-cutting steel for machine structural use having, in addition to the secured balance of the machinability and the chip-breakability, good fatigue strength and good bend-staightenability is also included in the object of the present invention.

The free-cutting steel for machine structural use according to the present invention achieving the above-mentioned object, or the steel having good machinability as well as good chip-breakability consists essentially of, as the basic alloy composition, by wt. %, C: 0.05–0.8%, Si: 0.01–2.0%, Mn: 0.1–3.5%, S: 0.01–0.2%, Al: 0.001–0.020%, Ca: 0.0005–0.02%, O: 0.0005–0.01% and N: 0.001–0.04%, and further, one or both of Ti: 0.002–0.010% and Zr: 0.002–0.025%, the balance being Fe and inevitable impurities, and is characterized in that the area occupied by the sulfide inclusion particles containing Ca of 1–45 wt. % and neighboring to oxide inclusion particles containing CaO of 0.2–62 wt. % and having melting point of 1500–1750° C. is $2.0\times10^{-4}$ $mm^2$ per 3.5 $mm^2$ or more in microscopic field, and that the sulfide inclusion particles other than the above defined sulfide inclusion particles are finely dispersed as MnS in the steel.

DETAILED EXPLANATION OF THE PREFERRED EMBODIMENTS

Figure 1:
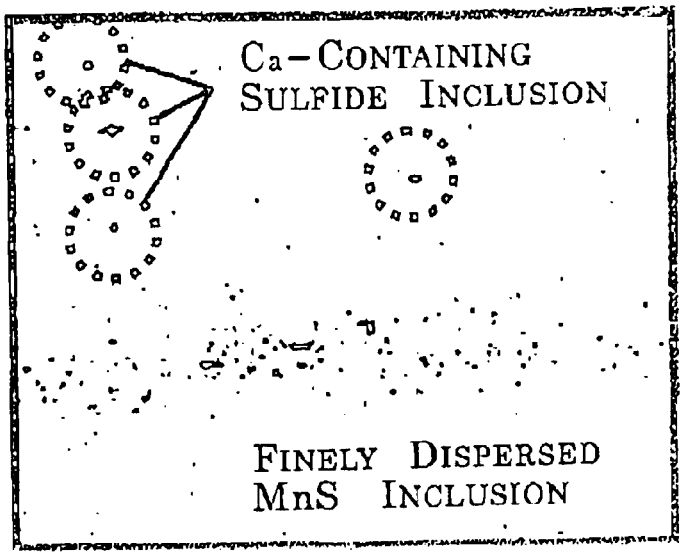
FIG. 1 is a microscopic photograph showing the shape of inclusions in the free-cutting steel for machine structural use according to the present invention.

The method for producing the above described free-cutting steel for machine structural use according to the present invention comprises the steps of preparing an alloy consisting essentially of, by wt. %, C: 0.05–0.8%, Si: 0.01–2.0%, Mn: 0.1–3.5%, S: 0.01–0.2%, Al: 0.001–0.020%, Ca: 0.0005–0.02%, O: 0.0005–0.01% and N: 0.001–0.04%, the balance being Fe and inevitable impurities, by melting and refining process for the conventional steel making, in which controlled deoxidization is conducted under the following conditions:

[S]/[O]: 8–40
[Ca]×[S]: $1\times10^{-5-1\times10-3}$
[Ca]/[S]: 0.01–20 and so as to adjust the area percentage of the sulfide inclusion particles containing Ca of 1–45 wt. % and neighboring to oxide inclusion particles containing CaO of 0.2–62 wt. % and having melting point of 1500–1750° C. to $2.0\times10^{-4}$ $mm^2$ per 3.5 $mm^2$ or more of the microscopic field, and thereafter, adding one or both of Ti: 0.002–0.010% and/or Zr: 0.002–0.025% so as to form fine Ti-oxide and/or Zr-oxide by reaction of oxygen with Ti and/or Zr in the steel after the above controlled deoxidization, and to utilize the resulting composite oxide particles as the nuclei for precipitation and fine dispersion of MnS inclusion particles.

The following explains the reasons for selecting the basic alloy composition of the present free-cutting steel for machine structural use as noted above.

C: 0.05–0.8%

Carbon is an element necessary for ensuring strength of the steel, and at content less than 0.05% the strength is insufficient for machine structural use. On the other hand, carbon enhances the activity of sulfur, and at a high C-content it will be difficult to obtain the duplex inclusion which can be obtained only under the specific balance of [S]/[O], [Ca]×[S], [Ca]/[S] and specific amount of [Al]. Also, a large amount of C lowers resilience and machinability of the steel, and the upper limit of 0.8% is thus decided.

Si: 0.01–2.0%

Silicon is used as a deoxidizing agent at steel making and becomes a component of the steel to increase hardenability thereof. These effects are not available at such a small Si-content as less than 0.01%. Si also enhances the activity of S. A large Si-content causes the same problem as caused by a large amount of C, and it is apprehensive that formation of the duplex inclusion may be prevented. A large content of Si damages ductility of the steel and cracks may occur at plastic processing. Thus, 2.0% is the upper limit of addition.

Mn: 0.1–3.5%

Manganese is an essential element to form sulfides. Mn-content less than 0.1% gives insufficient amount of sulfides, while an excess amount more than 3.5% hardens the steel to decrease machinability.

S: 0.01–0.2%

Sulfur is rather necessary than useful for improving machinability of the steel, and therefore, at least 0.01% of S is added. In order to achieve the fivefold or more tool life ratio S of 0.01% or more is necessary. S-content more than 0.2% not only damages resilience and ductility, but also causes formation of CaS, which has a high melting point and makes casting the steel difficult.

Al: 0.001–0.020%

Aluminum is necessary for realizing suitable composition of oxide inclusions and is added in an amount of at least 0.001%. At an Al-content more than 0.020% hard alumina cluster will form and lowers machinability of the steel. Regulation of the Al-content must be carried out in the process of preparing the present free-cutting steel prior to addition of Ti and/or Zr. This will be explained later.

Ca: 0.0005–0.02%

Calcium is a very important component of the steel according to the invention. In order to have Ca contained in the sulfides it is essential to add at least 0.0005% of Ca. On the other hand, addition of Ca exceeding 0.02% causes, as mentioned above, formation of high melting point CaS, which makes the casting of the product steel difficult.

O: 0.0005–0.0100%

Oxygen is an element necessary for forming the oxides. In the extremely deoxidized steel high melting point CaS will form and cause trouble in casting, and therefore, at least 0.0005%, preferably 0.015% or more, of O is necessary. On the other hand, O of 0.0100% or more will give much amount of hard oxides, which makes it difficult to form the desired calcium sulfide and damages machinability of the steel. Deoxidization with double deoxidizing agents, Ca and Al, causes formation of CaO—$Al_2O_3$ type inclusions, which are low melting point inclusions favorable for the machinability without improving chip-breakability. Therefore, it is preferable to minimize formation of CaO—$Al_2O_3$ type inclusions. For this purpose it is preferable to take the procedure of adjusting the Al-amount in a suitable range as mentioned above to achieve a suitable extent of deoxidization and then adding Ca.

In addition to formation of the composite oxide inclusions, O contributes to make MnS particles fine by combining with Ti and/or Zr to form fine oxide particles, which offer nuclei for MnS-precipitation. To enjoy this effect it is necessary to form a certain minimum amount of Ti-oxide, Zr-oxide or (Ti+Zr)-oxide, to which Mn-oxide may accompany as mentioned above, and therefore, the above-noted condition, [O]/[N]: 0.06 or more, should be met. As is well known, N tends to combine with Ti and Zr and, if these nitrides formed, formation of oxides will be insufficient.

N: 0.001–0.04%

N is an element useful for preventing coarsening of crystal grains. Also, N is important due to combination with Ti to form TiN. From this point of view addition of N in the amount of 0.001% or more is essential. Excess N results in casting defects and thus, the upper limit of 0.04% is set.

One or two of Ti: 0.002–0.010% and Zr: 0.002–0.025%

Ti and Zr of small amounts combine with O in the steel deoxidized with Ca and Al to form fine oxides. As noted above, the oxide particles take the role of nuclei for MnS-precipitation and contribute to fine dispersion of MnS. It is advantageous to use both Ti and Zr (for example, Ti 0.005%+Zr 0.015%) because high effect of comminuting the MnS inclusion particles can be obtained. In order to have suitable amounts of Ti-oxide and Zr-oxide formed without giving influence on the formation of the above duplex inclusion and other oxides, it is necessary to control the amounts of Ti and Zr in the ranges of 0.002–0.010% and 0.002–0.025%, respectively. It is also essential for ensuring formation of the duplex inclusion to practice the controlled deoxidization and thereafter, addition of Ti and Zr.

In case where Ti forms fine Ti(CN) particles, they suppress growth of former austenite crystal grain during hot forging. To enjoy this effect it is necessary to provide the Ti of the amount at least 0.002%, the above-noted lower limit, and to satisfy the condition [Ti]×[N]: $5\times10^{-6}$ to $2\times10^{-4}$. Of the steel according to the invention those satisfying these balances exhibit high fatigue strength and good bend-straightenability, and therefore, are suitable as the materials of crank shafts and connecting rods, to which these properties are required.

Phosphor, an inevitable impurity, is harmful for resilience of the steel, and existence in an amount more than 0.2% is unfavorable. However, in this limit P improves machinability, particularly turned surface properties. This effect is appreciable at a content of 0.001% or higher.

The free-cutting steel of this invention may further contain, in addition to the above-discussed basic alloy components, at least one element selected from the respective groups in an amount or amounts defined below. The following explains the roles of the optionally added alloying elements in the modified embodiments and the reasons for limiting the composition ranges.

One or both of Cr: up to 3.5% and Mo: up to 2.0%

Chromium and molybdenum enhance hardenability of the steel, and so, it is recommended to add a suitable amount or amounts of the element or elements. However, addition of a large amount or amounts will damage hot workability of the steel and causes cracking. Also from the view point of manufacturing cost the respective upper limits are set to be 3.5% for Cr and 2.0% for Mo.

Cu: up to 2.0%

Copper makes the structure of steel fine and heightens strength of the steel. Much addition is not desirable from the viewpoints of hot workability and machinability. Addition amount should be up to 2.0%.

Ni: up to 4.0%

Nickel also enhances hardenability of the steel. This is a component unfavorable to the machinability. Taking the manufacturing cost into account, 4.0% is chosen as the upper limit.

B: 0.0005–0.01%

Boron enhances hardenability of the steel even at a small content. To obtain this effect addition of B of 0.0005% or more is necessary. B-content more than 0.01% is harmful due to decreased hot workability.

Mg: up to 0.02%

Magnesium is effective to form oxide inclusion particles which become nuclei for the double structure inclusion particles. Addition of a large amount of Mg results in formation of MgS. MgS reacts CaO to form CaS, which gives difficulty in casting. The upper limit, 0.2%, is thus set.

Nb: up to 0.2%

Niobium is useful for preventing coarsening of crystal grains of the steel at high temperature. Because the effect saturates as the addition amount increases, it is advisable to add Nb in an amount up to 0.2%.

V: up to 0.5%

Vanadium combines with carbon and nitrogen to form carbonitride, which makes the crystal grains of the steel fine. This effect saturates at V-content more than 0.5%.

Pb: up to 0.4%, Bi: up to 0.4%

Both lead and bismuth are machinability-improving elements. Lead exists, as the inclusion in the steel, alone or with sulfide in the form of adhered matter on outer surfaces of the sulfide inclusion particles and improves machinability. The upper limit, 0.4%, is set because, even if a larger amount is added, excess lead will not dissolve in the steel and coagulate to form defects in the steel ingot. The reason for setting the upper limit of Bi is the same.

Se: up to 0.4%, Te: up to 0.2%

Se and Te are also machinability-improving elements. The respective upper limits of addition, 0.4% for Se and 0.2% for Te, were decided on the basis of unfavorable influence on hot workability of the steel.

Figure 2:
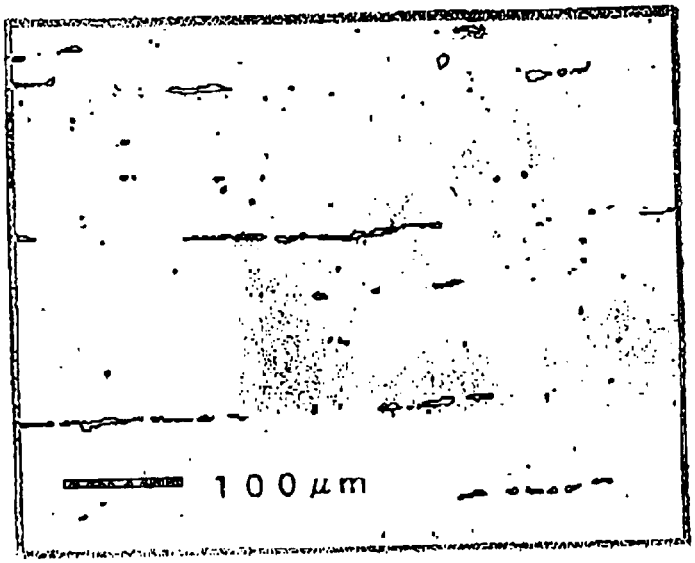
FIG. 2 is a microscopic photograph also showing the shape of inclusions in the conventional sulfur-containing free-cutting steel.

The inclusions existing in the free-cutting steel for machine structural use according to the invention are, as seen in FIG. 1, the duplex inclusion and the MnS inclusion. EPMA analysis revealed that the core consists of oxides of Ca, Mg, Si and Al, and the core is surrounded by MnS containing CaS. The MnS inclusion particles in this steel of the invention are finely dispersed. Contrary to this, the MnS inclusion particles of the conventional free-cutting steel in which machinability-improving effect by MnS is simply sought are, as seen in FIG. 2, large and elongated during rolling.

The shape and the amount of the duplex inclusion are essential for achieving good machinability of the fivefold tool life ratio aimed by the present invention and good chip-breakability through the mechanism discussed later. The significance of the shape and the amount will be, though partly mentioned in the disclosure of the prior invention, explained below with novel knowledge.

Figure 3:
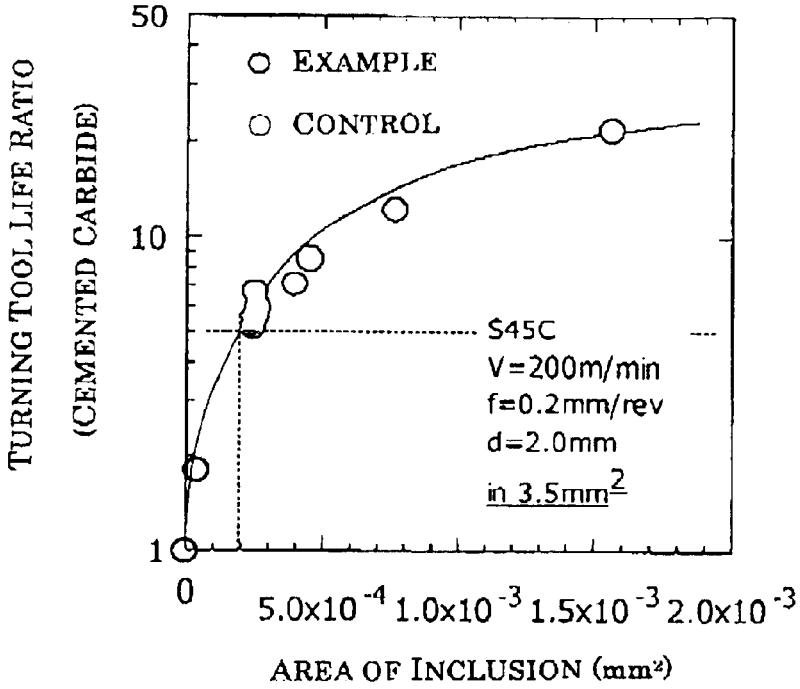
FIG. 3 is a graph showing the relation between area occupied by the "duplex inclusion" and tool life of free-cutting steel for machine structural use.

The area occupied by the sulfide inclusions containing Ca of 1.0% or more neighboring to the oxide inclusions containing CaO of 0.2–62% is $2.0\times10^{-4}$ mm$^2$ per 3.5 mm$^2$ or more in the microscopic field:

The relation between the area occupied by the inclusion satisfying the above condition and tool life ratio obtained by turning with cemented carbide tool of the present steels and the conventional sulfur free-cutting steel of the same S-contents is shown in FIG. 3. The data in FIG. 3 were obtained by turning S45C-series free-cutting steel of the invention, and show that the results of the fivefold tool life ratio is achieved only when the duplex inclusion occupies the area of $2.0\times10^{-4}$ mm$^2$ or more.

Figure 4:
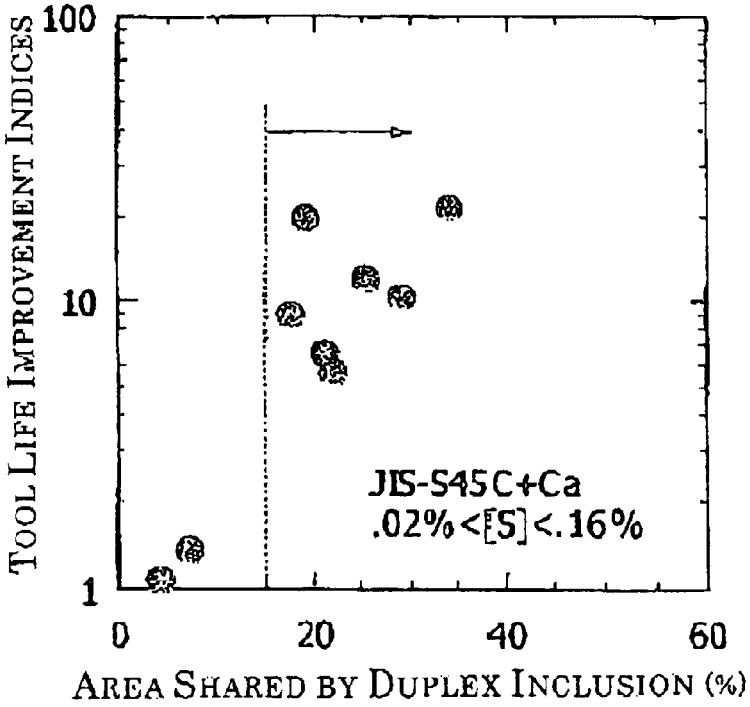
FIG. 4 is a graph showing the relation between the area shared by the "duplex inclusion" in total sulfide inclusions and tool life of free-cutting steel for machine structural use.

The area occupied by the finely dispersed MnS inclusion particles having averaged diameter of 1.0 $\mu$m or more shares 60–85% and the area occupied by the sulfide inclusion particles containing Ca of 1–45 wt. % and neighboring to oxide inclusion particles containing CaO of 0.2–62 wt. % and having melting point of 1500–1750° C. shares 40–15% of the microscopic field:

For the tool life, the steel containing much duplex inclusion in the total sulfide inclusions is preferable. To achieve the fivefold tool life aimed by the invention it is necessary that the duplex inclusion shares at least 15% of the total sulfide inclusion. This is shown in FIG. 4. On the other hand, it was found that, from the view to enhance the chip-breakability, percentage of simple sulfide inclusion other than the duplex inclusion must not be lower than a certain limit. This is the limit that the share of the duplex inclusion in the total sulfide inclusions is not more than 40%. Support for this can be found in FIG. 5.

Figure 5:
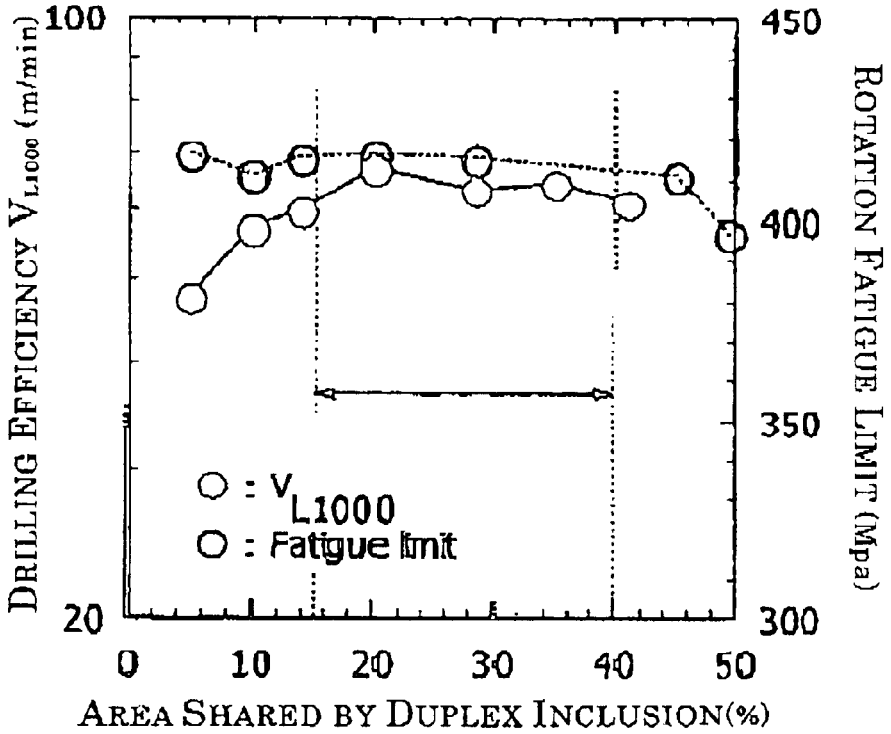
FIG. 5 is a graph showing the relation between the area shared by the "duplex inclusion" in total sulfide inclusions and drilling efficiency as well as rotation fatigue limits of free-cutting steel for machine structural use.
Figure 6:
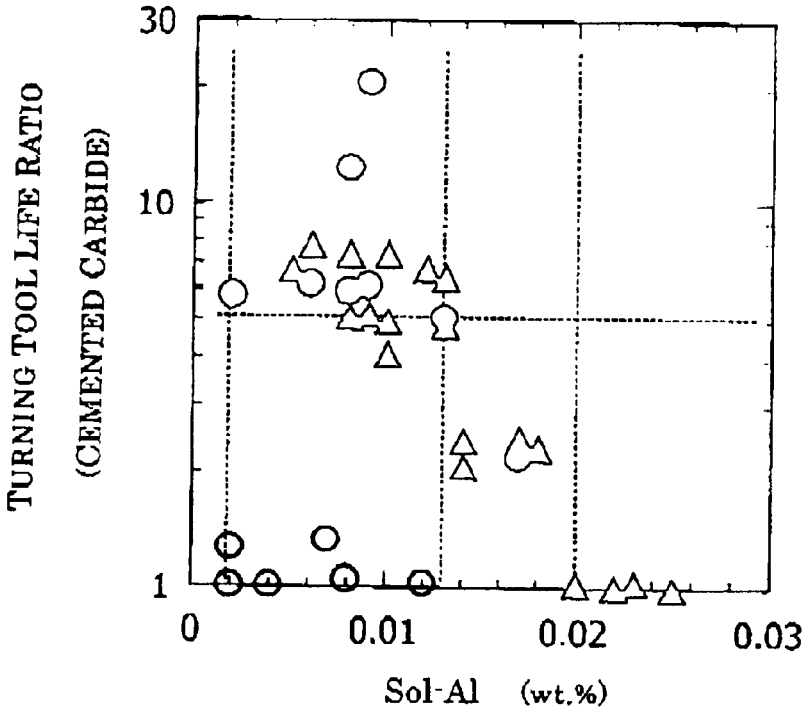
FIG. 6 is a graph obtained by plotting the relation between Al-contents and tool lives of free-cutting steel for machine structural use.

The graph of FIG. 5 shows the significance of the area percentage of 40% or less also in regard to the rotary bending fatigue limit. To the machine parts which receive repeated bending stress a high rotary bending fatigue limit (a limit of stress at which or lower no fatigue failure occurs even if repeatedly posed) is required. If the duplex inclusion becomes dominant to reach the level of 40% or more, very big duplex inclusion particles may form and, due to the mechanism that cracks occur and propagate from them to cause failure. Then, the rotary bending fatigue limit will decrease, and thus, it is preferable that the area percentage of the duplex inclusion does not exceed 40%.

Conditions for realizing the above-described features of the inclusions are the above-noted operation conditions. Significance of the conditions has been already explained in regard to the previous invention. However, the explanation will be, due to the importance thereof, set forth again.

[S]/[O]: 8–80

Figure 7:
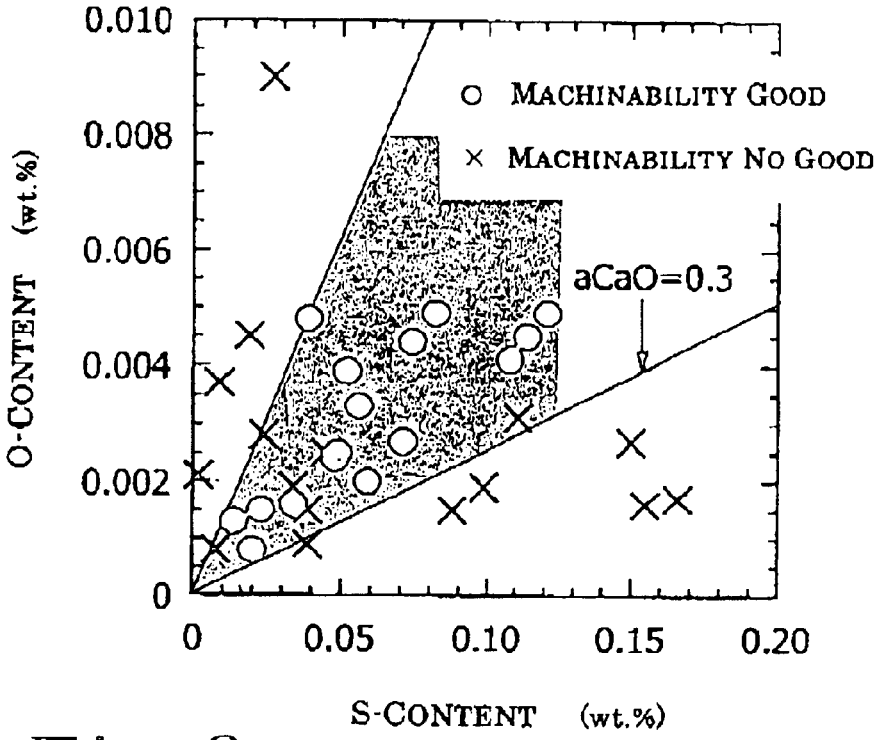
FIG. 7 is a graph showing whether or not the "duplex inclusion" is formed in the free-cutting steel for machine structural use with various S-contents and O-contents.

Whether the aim of the fivefold tool life ratio is achieved or not in relation to the free-cutting steel for machine structural use of various S-contents and O-contents is shown by different plots in the graph of FIG. 7. Those successful (with ● plots) are in the triangle area between the line of [S]/[O]=8 and the line of [S]/[O]=80, and those not successful (with X plots) are out of the triangle area.

[Ca]/[S]: 0.01–20 and
[Ca]×[S]: $1\times10^{-5-1\times10-3}$

Figure 8:
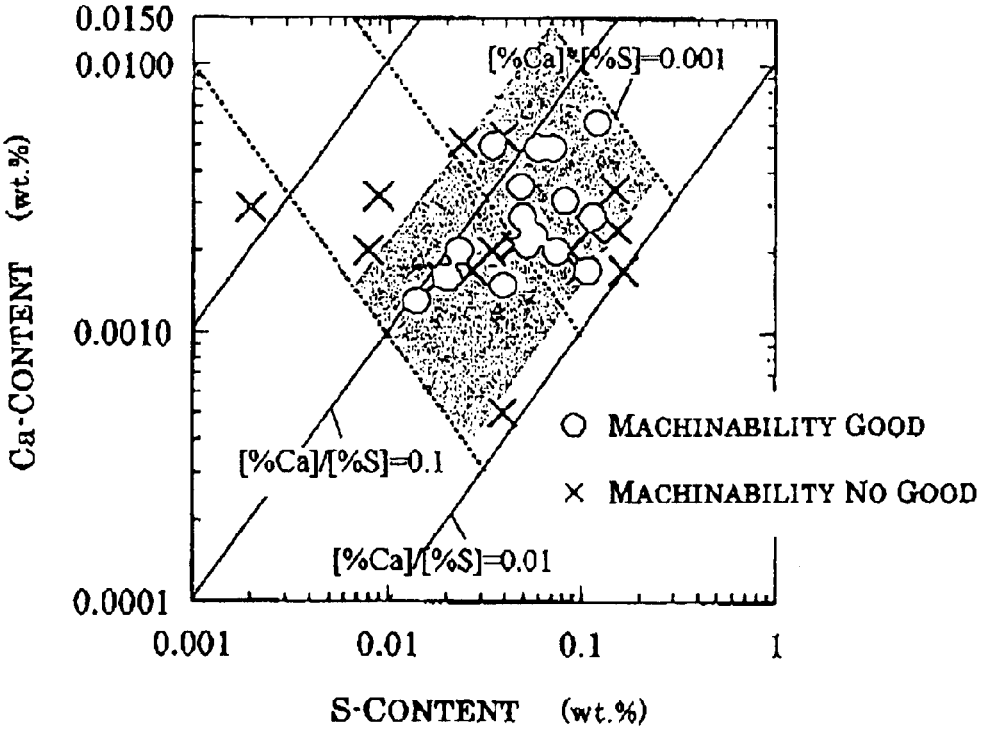
FIG. 8 is a graph showing whether or not the aim of this invention, the fivefold tool life ratio, is achieved by the free-cutting steel for machine structural use with various S-contents and Ca-contents.

Like the above data, whether the aim of the fivefold tool life ratio is achieved or not in relation to the free-cutting steel for machine structural use of various S-contents and Ca-contents is shown in the graph of FIG. 8. It will be seen from the graph that those successful (with ● plots) are concentrated in the quadrilateral area surrounded by the lines of [Ca]/[S]=0.01 and 20 and lines of [Ca]×[S]=$1\times10^{-5}$ and $1\times10^{-3}$. All of those fulfilling the above conditions concerning [S]/[O], [Ca]/[S] and [Ca]×[S] achieved the aim of the fivefold tool life ratio.

As the reason for the good machinability of the steel for machine structural use according to the invention the inventors consider the following mechanism of improved protection and lubrication by the duplex inclusion. This is also explained in the disclosure of the previous invention, however, the following explains again.

The duplex inclusion particle has a core of $CaO.Al_2O_3$-based composite oxides and the circumference of the core is surrounded by (Ca, Mn)-based composite sulfides. These oxides in question have relatively low melting points out of the $CaO.Al_2O_3$-based oxides, while the composite sulfide has a melting point higher than that of simple sulfide or MnS. The duplex inclusion surely precipitates by such arrangement that the $CaO.Al_2O_3$-based oxide of a low melting point may be in the form that the sulfides envelop the oxides. It is well known that, at cutting, the inclusions soften to coat the surface of the tool to protect it. If the inclusion is only of the sulfide, formation and duration of the coating film is not stable, however, according to the discovery by the inventors coexistence of low melting point oxide of $CaO.Al_2O_3$-base with the sulfide brings about stable formation of the coating film, and further, the composite sulfide of (Ca,Mn)S-base has lubricating effect better than that of the simple MnS.

The significance of formation of coating film on the tool edge by the composite sulfide of (Ca,Mn)S-base is to suppress so-called "heat diffusion abrasion" of cemented carbide tools. The heat diffusion abrasion is the abrasion of the tools caused by embrittlement of the tool through the mechanism that the tool contacts cut chips coming from the material just cut at a high temperature followed by thermal decomposition of carbide, represented by wolfram carbide WC, and resulting loss of carbon by diffusion into the cut chips. If a coating of high lubricating effect is formed on the tool edge, temperature increase of the tool will be prevented and diffusion of carbon will thus be suppressed.

The duplex inclusion $CaO—Al_2O_3/(Ca,Mn)S$ can be interpreted to have the merit of MnS, which is the inclusion in the conventional sulfur free-cutting steel, and the merit given by anorthite inclusion, $CaO.Al_2O_3.2SiO_2$, which is the inclusion in the conventional calcium free-cutting steel, in combination. The MnS inclusion exhibits lubricating effect on the tool edge, while the stability of the coating film is somewhat dissatisfactory, and has no competence against the heat diffusion abrasion. On the other hand, $CaO.Al_2O_3.2SiO_2$ forms a stable coating film to prevent the thermal diffusion abrasion, while has little lubrication effect. The duplex inclusion of the present invention forms a stable coating film to effectively prevent the thermal diffusion abrasion, and at the same time, offer better lubricating effect.

Formation of the duplex inclusion begins with, as mentioned above, preparation of the low melting temperature composite oxides, and therefore, the amount of [Al] is important. At least 0.001% of [Al] is essential. However, if [Al] is too much the melting point of the composite oxide will increase, and thus, the amount of [Al] must be up to 0.020%. Then, for the purpose of adjusting the amount of CaS formed the values of [Ca]×[S] and [Ca]/[S] are controlled to the above mentioned levels.

The above-discussed mechanism is not just a hypothesis, but accompanied by evidence. This was supported by comparison of the surface of a cemented carbide tools used for turning the free-cutting steel according to the previous invention and analysis of the melted, adhered inclusion with the case of turning conventional sulfur free-cutting steel.

The improved chip-breakability which characterizes the present free-cutting steel for machine structural use is brought about, as mentioned above, by comminution of the MnS inclusion particles. With the requisite that the total amount of the inclusions is constant, comminution means increase of the number of the particles. The amount of the MnS inclusion in the present steel depends mainly on the content of sulfur. S-content varies in the range of 0.01–0.2%, and due to the resulting variety of the MnS amount, the number of the comminuted inclusion particles varies. In the present free-cutting steel MnS inclusion particles are finer than those in the conventional free-cutting steel. Of the fine particles the particles which influence the chip-breakability are those having averaged particle sizes of 1.0 $\mu$m or more. ("Averaged particle size" here means an averaged value of long diameter and short diameter of the particle section in microscopic field.)

Search was conducted on the numbers of the MnS inclusion particles having averaged diameter of 1.0 $\mu$m or more per unit section ($mm^2$) in the steel according to the invention with various S-contents but all having good chip-breakability by optical microscope at magnitude 400. The results are as shown below, and it was concluded that the relation between the numbers of the particles and S-contents is nearly constant.

| S-Content in Steel | Number of MnS Inclusion Particles | Number of Particles per 0.01%-S |
|---|---|---|
| 0.01% | 5.4/$mm^2$ | 5.4/$mm^2$ |
| 0.03% | 16.2/$mm^2$ | 5.4/$mm^2$ |
| 0.062% | 32.0/$mm^2$ | 5.2/$mm^2$ |
| 0.125% | 77.0/$mm^2$ | 6.2/$mm^2$ |

Figure 9:
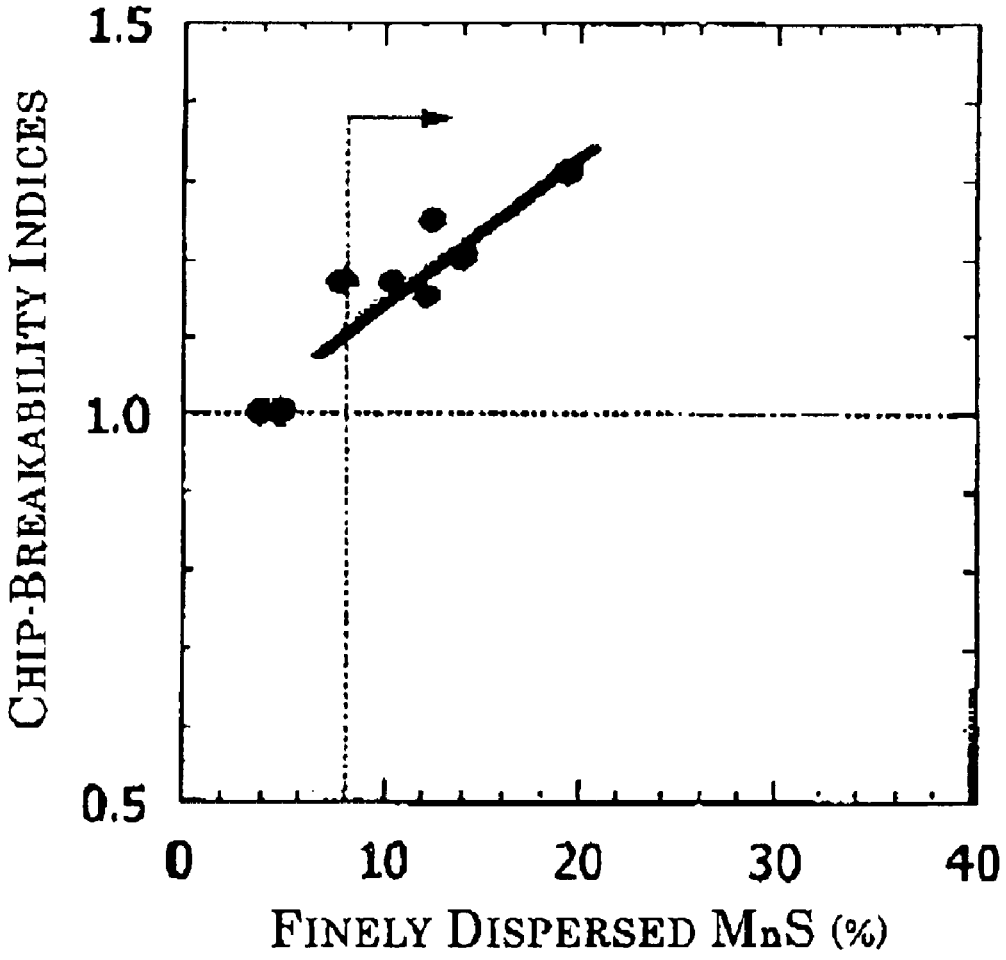
FIG. 9 is a graph showing the relation between the percentage shared by fine MnS particles of the MnS inclusions and chip-breakability in the free-cutting steel for machine structural use.

Based on this data it was concluded that, over wide range of S-contents, if the number of MnS inclusion particles is not less than 5-particles/$mm^2$ per 0.01%-S, good chip-breakability can be obtained. The graph of FIG. 9 clearly shows this. The graph is prepared by plotting the relation between the percentage of the MnS inclusion particles having averaged diameters of 1.0 $\mu$m or more and smaller than those of the MnS inclusion particles of the conventional free-cutting steel and the chip-breakability. The graph shows that, the higher the percentage of the smaller MnS inclusion particles is, the higher the chip-breakability indices are.

The free-cutting steel for machine structural use according to the present invention exhibits good machinability of the same level as in the free-cutting steel of the previous invention. Because the duplex inclusion exists in the best form in the steel, it is easy to achieve the aim of the invention, the fivefold tool life ratio to the conventional sulfur free-cutting steel in machining, particularly, turning with a cemented carbide tool.

The fairly good chip-breakability realized in the free-cutting steel of the previous invention was given by adding a small amount of Ti (or Zr) to form finely dispersed MnS inclusion particles. This effect is obtained also in the free-cutting steel of the present invention. The fact that the chip-breakability is high is of course particularly favorable to turning. In the steel in which fine Ti(C,N)-particles are formed, growth of former austenite crystal grains during hot processing is suppressed, and therefore, the steel enjoys, not only the good machinability and chip-breakability, but also good fatigue strength and bend-straightenability, and is suitable for the use where these properties are required.

The present method of producing is the method by which the above-described free-cutting steel for machine structural use can be surely produced. The method is characterized by regulating Al-content before addition of Ca and other components to carry out the controlled deoxidization, and advantageously forming the duplex inclusion, then, at a suitable timing, or after formation of the duplex inclusion by the controlled deoxidization, a suitable amount of Ti is added and thus, a free-cutting steel in which MnS inclusion particles are finely dispersed and further, the tool life and the chip-breakability are suitably balanced by a specific share of the duplex inclusion particles in the total sulfide inclusions. In case where the method of producing is carried out with suitable choice of Ti-content as well as O-content and N-content, fine Ti(C,N) particles are formed in the steel, and the product is a free-cutting steel for machine structural use having improved fatigue strength and bend-straightenability.

EXAMPLES

In the following examples the runs with numbers of capital letters (A1, B1, . . . ) are working examples and those with small letters (a1, b1, . . . ) are control examples. The alloys prepared were cast into ingots, from which test pieces of round rods having diameter 72 mm were cut out and used for testing. The method of tests and the criteria are as follows.

[Area Occupied by the Duplex Inclusion]

The cases where the duplex inclusion or sulfide inclusion particles containing Ca and neighboring to oxide inclusion particles occupies an area of $2.0\times10^{-4}$ $mm^2$ per 3.5 $mm^2$ or more were marked "Yes", and the contrary cases, "No".

[Area Percentage of the Duplex Inclusion]

In microphotographs (magnitude 200) the total sulfide inclusions were classified into the simple sulfide inclusion and the duplex inclusion. Percentage of the area shared by the duplex inclusion was determined.

[Machinability]

Turning with a cemented carbide tool was carried out under the following conditions:

Cutting Speed: 200 m/min
Feed Rate: 0.2 mm/rev
Depth of Cut: 2.0 mm

Both in the successful case where the desired inclusion was obtained, and the case where the protection by the inclusion was obtained, the results were recorded "Yes", while in the not successful case the results were recorded "No". Taking the tool lives of the sulfur free-cutting steels in which S-contents are 0.01–0.2% as standards, the steels which achieved the aim of the invention, fivefold tool life ratio, were marked "Yes" and the steels which failed to achieve the above aim were marked "No".

[Chip-Breakabkility]

Chips occurred by cutting under the following conditions were collected:

Cutting Speed: 150 m/sec.
Feed: 0.025–0.200 mm/rev.
Depth: 0.3–1.0 mm
Tool: DNMG150480-MA Respective points 0–4 were assigned to the chips depending on the length thereof. The sums of the points for total 30 cutting conditions were recorded as "chip-breakability indices". The obtained indices were compared with the chip-breakability indices obtained for the sulfur-containing free-cutting steels containing the same quantities of sulfur, and evaluated as follows:

better point: "Good" the same or lower point: "Poor"

Example 1

The invention was applied on S45C steel. The alloy compositions are shown in Table 1 (working examples) and Table 2 (control examples). Operation conditions of the free-cutting steels, component ratios and performance data such as tool lives and chip-breakabilities are shown together in Table 3 (working examples) and Table 4 (control examples).

In Tables 3 and 4 (also in subsequent Tables showing the test results) the abbreviations have the following meanings:

S/O: [S]/[O]
Ca.S: [Ca]×[A]
Ca/S: [Ca]/[S]
TiZrN: [Ti+Zr]×[N]
S.I. Area: area occupied by sulfide inclusions
MnS Numb.: number of MnS inclusion particles (particles/$mm^2$ per 0.01%-S)
D.S.I. Area: area percentage shared by the duplex inclusion (%)
Pro. Film: formation of tool-protecting film (Yes/No)
Mach.: machinability (Yes/No)
Chip-Brk.: chip-breakability (Good/Poor)

Example 2

The same producing procedures and machinability tests as those in Example 1 were applied to S15C steel. The alloy compositions are shown in Table 5 (working examples) and Table 6 (control examples), and the test results are shown in Table 7 (working examples) and Table 8 (control examples).

Example 3

The same producing procedures and machinability tests as those in Example 1 were applied to S55C steel. The alloy compositions are shown in Table 9 (working examples) and Table 10 (control examples), and the test results are shown in Table 11 (working examples) and Table 12 (control examples).

Example 4

The same producing procedures and machinability tests as those in Example 1 were applied to SCR415 steel. The alloy compositions are shown in Table 13 (working examples) and Table 14 (control examples), and the test results are shown in Table 15 (working examples) and Table 16 (control examples).

Example 5

The same producing procedures and machinability tests as those in Example 1 were applied to SCM440 steel. The alloy compositions are shown in Table 17 (working examples) and Table 18 (control examples), and the test results are shown in Table 19 (working examples) and Table 20 (control examples).

TABLE 1

S45C Working Examples (wt. %, balance Fe)
Alloy Compositions (wt. %, balance Fe)

| No. | C | Si | Mn | P | S | Al | O | N | Ca | Others |
|---|---|---|---|---|---|---|---|---|---|---|
| A1 | 0.44 | 0.21 | 0.81 | 0.022 | 0.039 | 0.006 | 0.0048 | 0.0077 | 0.0015 | Ti0.0041 |
| A2 | 0.46 | 0.25 | 0.74 | 0.015 | 0.074 | 0.005 | 0.0044 | 0.0100 | 0.0020 | Ti0.0050 |
| A3 | 0.45 | 0.26 | 0.80 | 0.015 | 0.049 | 0.003 | 0.0025 | 0.0095 | 0.0027 | Mg0.0021<br>Ti0.0049 |
| A4 | 0.44 | 0.27 | 0.74 | 0.016 | 0.048 | 0.005 | 0.0024 | 0.0152 | 0.0035 | Mg0.0034<br>Ti0.0065<br>Pb0.07 |
| A5 | 0.44 | 0.25 | 0.91 | 0.019 | 0.121 | 0.002 | 0.0049 | 0.0125 | 0.0061 | Ti0.0075 |
| A6 | 0.44 | 0.25 | 0.74 | 0.016 | 0.020 | 0.006 | 0.0008 | 0.0060 | 0.0016 | Ti0.0044 |
| A7 | 0.46 | 0.25 | 0.75 | 0.015 | 0.059 | 0.006 | 0.0020 | 0.0125 | 0.0049 | Mg0.0034<br>Ti0.0095<br>Pb0.15 |
| A8 | 0.45 | 0.26 | 0.71 | 0.014 | 0.040 | 0.005 | 0.0022 | 0.0088 | 0.0022 | Ti0.018 |
| A9 | 0.44 | 0.25 | 0.70 | 0.015 | 0.041 | 0.006 | 0.0024 | 0.0075 | 0.0023 | Zr0.035 |
| A10 | 0.43 | 0.27 | 0.74 | 0.015 | 0.057 | 0.006 | 0.0025 | 0.0180 | 0.0020 | Ti0.0045<br>Zr0.0014 |
| A11 | 0.44 | 0.27 | 0.69 | 0.014 | 0.044 | 0.007 | 0.0024 | 0.0084 | 0.0022 | Ti0.0034<br>Zr0.0024<br>REM0.0021 |
| A12 | 0.44 | 0.25 | 0.71 | 0.015 | 0.069 | 0.008 | 0.0020 | 0.0114 | 0.0030 | Ti0.0040<br>REM0.0051 |
| A13 | 0.46 | 0.30 | 0.88 | 0.014 | 0.107 | 0.007 | 0.0018 | 0.0101 | 0.0021 | Ti0.0032 |
| A14 | 0.46 | 0.27 | 0.86 | 0.011 | 0.104 | 0.007 | 0.0015 | 0.0094 | 0.0024 | Mg0.0011<br>Ti0.0044 |

TABLE 2

S45C Control Examples
Alloy Compositions (wt. %, balance Fe)

| No. | C | Si | Mn | P | S | Al | O | N | Ca | Others |
|---|---|---|---|---|---|---|---|---|---|---|
| a1 | 0.45 | 0.25 | 0.74 | 0.014 | 0.002 | 0.006 | 0.0021 | 0.0111 | 0.0029 | — |
| a2 | 0.45 | 0.25 | 0.76 | 0.015 | 0.027 | 0.013 | 0.0090 | 0.0109 | 0.0017 | — |
| a3 | 0.45 | 0.25 | 0.75 | 0.015 | 0.019 | 0.009 | 0.0045 | 0.0124 | 0.0016 | Mg0.0055 |
| a4 | 0.44 | 0.25 | 0.76 | 0.016 | 0.008 | 0.006 | 0.0008 | 0.0072 | 0.0020 | Mg0.0057<br>Pb0.06 |
| a5 | 0.42 | 0.24 | 0.81 | 0.017 | 0.121 | 0.006 | 0.0031 | 0.0141 | 0.0011 | Mg0.0033<br>Ti0.005 |
| a6 | 0.44 | 0.24 | 0.77 | 0.020 | 0.099 | 0.005 | 0.0019 | 0.0076 | 0.0017 | — |
| a7 | 0.44 | 0.25 | 0.78 | 0.006 | 0.014 | 0.008 | 0.0013 | 0.0089 | 0.0013 | — |
| a8 | 0.45 | 0.32 | 0.75 | 0.015 | 0.052 | 0.002 | 0.0039 | 0.0140 | 0.0021 | Mg0.0033 |
| a9 | 0.43 | 0.31 | 0.80 | 0.012 | 0.023 | 0.014 | 0.0015 | 0.0121 | 0.0020 | Ti0.22<br>Pb0.07 |
| a10 | 0.41 | 0.27 | 0.78 | 0.009 | 0.082 | 0.005 | 0.0049 | 0.0144 | 0.0031 | — |
| a11 | 0.44 | 0.24 | 0.75 | 0.016 | 0.071 | 0.004 | 0.0027 | 0.0155 | 0.0049 | — |

TABLE 3

S45C Working Examples
Components and Test Results

| No. | S/O | Ca S $\times 10^{-5}$ | Ca/S | TiZrN $\times 10^{-6}$ | O/N | SI Area | MnS Numb. | DSI Area | Pro. Film | Mach | Chip Brk. |
|---|---|---|---|---|---|---|---|---|---|---|---|
| A1 | 8.1 | 5.9 | 0.038 | 31.6 | 0.62 | Yes | 13.7 | 19 | Yes | Good | Good |
| A2 | 16.8 | 14.8 | 0.027 | 50.0 | 0.44 | Yes | 6.2 | 29 | Yes | Good | Good |
| A3 | 19.6 | 13.2 | 0.055 | 46.6 | 0.26 | Yes | 8.1 | 22 | Yes | Good | Good |
| A4 | 20.0 | 16.8 | 0.073 | 98.8 | 0.16 | Yes | 7.1 | 34 | Yes | Good | Good |
| A5 | 24.7 | 73.8 | 0.050 | 93.8 | 0.39 | Yes | 9.6 | 21 | Yes | Good | Good |
| A6 | 25.0 | 3.2 | 0.080 | 26.4 | 0.13 | Yes | 10.3 | 17 | Yes | Good | Good |
| A7 | 29.5 | 28.9 | 0.083 | 118.8 | 0.16 | Yes | 8.2 | 36 | Yes | Good | Good |
| A8 | 18.2 | 8.8 | 0.055 | 158.4 | 0.32 | Yes | 9.5 | 26 | Yes | Good | Good |

TABLE 3-continued

S45C Working Examples
Components and Test Results

| No. | S/O | Ca S $\times 10^{-5}$ | Ca/S | TiZrN $\times 10^{-6}$ | O/N | SI Area | MnS Numb. | DSI Area | Pro. Film | Mach | Chip Brk. |
|---|---|---|---|---|---|---|---|---|---|---|---|
| A9 | 17.1 | 9.4 | 0.056 | 26.3 | 0.32 | Yes | 7.6 | 21 | Yes | Good | Good |
| A10 | 22.8 | 11.4 | 0.035 | 106.2 | 0.14 | Yes | 9.8 | 23 | Yes | Good | Good |
| A11 | 18.3 | 9.7 | 0.050 | 48.7 | 0.29 | Yes | 8.0 | 29 | Yes | Good | Good |
| A12 | 34.5 | 20.7 | 0.043 | 45.6 | 0.18 | Yes | 7.5 | 32 | Yes | Good | Good |
| A13 | 59.4 | 22.5 | 0.020 | 32.3 | 0.18 | Yes | 11.2 | 17 | Yes | Good | Good |
| A14 | 69.3 | 25.0 | 0.023 | 41.4 | 0.16 | Yes | 13.6 | 18 | Yes | Good | Good |

TABLE 4

S45C Control Examples
Components and Test Results

| No. | S/O | Ca S $\times 10^{-5}$ | Ca/S | TiZrN $\times 10^{-6}$ | O/N | SI Area | MnS Numb. | DSI Area | Pro. Film | Mach | Chip Brk. |
|---|---|---|---|---|---|---|---|---|---|---|---|
| a1 | 1.0 | 0.6 | 1.450 | — | 0.19 | No | 4.1 | 8 | No | Int. | Poor |
| a2 | 3.0 | 4.6 | 0.063 | — | 0.83 | No | 3.6 | 11 | No | Int. | Poor |
| a3 | 4.2 | 3.0 | 0.084 | — | 0.36 | No | 2.8 | 13 | No | Int. | Poor |
| a4 | 10.0 | 1.6 | 0.250 | — | 0.11 | No | 5.3 | 5 | No | Poor | Good |
| a5 | 35.8 | 26.6 | 0.009 | 70.5 | 0.22 | Yes | 9.2 | 9 | No | Poor | Good |
| a6 | 52.1 | 16.8 | 0.017 | — | 0.25 | No | 4.0 | 6 | No | Poor | Poor |
| a7 | 4.1 | 10.8 | 0.093 | — | 0.15 | Yes | 2.5 | 47 | Yes | Good | Poor |
| a8 | 13.3 | 10.9 | 0.040 | — | 0.28 | Yes | 3.1 | 53 | Yes | Good | Poor |
| a9 | 15.3 | 4.6 | 0.087 | 2662 | 0.12 | Yes | 3.7 | 8 | Yes | Good | Good |
| a10 | 16.7 | 25.4 | 0.038 | — | 0.34 | Yes | 1.8 | 43 | Yes | Good | Poor |
| a11 | 26.3 | 34.8 | 0.069 | — | 0.17 | Yes | 3.8 | 50 | Yes | Good | Poor |

TABLE 5

S15C Working Examples
Alloy Compositions (wt. %, balance Fe)

| No. | C | Si | Mn | P | S | Al | O | N | Ca | Others |
|---|---|---|---|---|---|---|---|---|---|---|
| B1 | 0.14 | 0.41 | 0.80 | 0.025 | 0.077 | 0.007 | 0.0033 | 0.0102 | 0.0017 | Ti0.0047<br>Cr0.02<br>Mo0.01 |
| B2 | 0.16 | 0.39 | 0.44 | 0.023 | 0.041 | 0.011 | 0.0022 | 0.0121 | 0.0021 | Ti0.0031<br>Cr0.15<br>Mo0.01 |
| B3 | 0.15 | 0.43 | 0.55 | 0.021 | 0.042 | 0.009 | 0.0024 | 0.0095 | 0.0022 | Ti0.0016<br>Cr0.16<br>Mo0.01 |
| B4 | 0.15 | 0.38 | 0.57 | 0.022 | 0.043 | 0.008 | 0.0023 | 0.0097 | 0.0023 | Zr0.0038<br>Cr0.16<br>Mo0.01 |
| B5 | 0.15 | 0.27 | 0.72 | 0.015 | 0.057 | 0.006 | 0.0025 | 0.0094 | 0.0024 | Ti0.0055<br>Zr0.0029<br>Mg0.0027<br>Cr0.17<br>Mo0.01 |

TABLE 6

S15C Control Examples
Alloy Compositions (wt. %, balance Fe)

| No. | C | Si | Mn | P | S | Al | O | N | Ca | Others |
|---|---|---|---|---|---|---|---|---|---|---|
| b1 | 0.15 | 0.33 | 0.39 | 0.016 | 0.015 | 0.016 | 0.0021 | 0.0109 | 0.0001 | Cr0.12<br>Mo0.01 |

TABLE 6-continued

S15C Control Examples
Alloy Compositions (wt. %, balance Fe)

| No. | C | Si | Mn | P | S | Al | O | N | Ca | Others |
|---|---|---|---|---|---|---|---|---|---|---|
| b2 | 0.16 | 0.32 | 0.62 | 0.016 | 0.091 | 0.022 | 0.0019 | 0.0133 | 0.0034 | Ti0.0088<br>Cr0.09<br>Mo0.01 |
| b3 | 0.14 | 0.27 | 1.00 | 0.020 | 0.089 | 0.002 | 0.0040 | 0.0121 | 0.0017 | Cr0.03<br>Mo0.01 |

TABLE 7

S15C Working Examples
Components and Test Results

| No. | S/O | Ca S $\times 10^{-5}$ | Ca/S | TiZrN $\times 10^{-6}$ | O/N | SI Area | MnS Numb. | DSI Area | Pro. Film | Mach | Chip Brk. |
|---|---|---|---|---|---|---|---|---|---|---|---|
| B1 | 18.6 | 8.6 | 0.051 | 47.9 | 0.32 | Yes | 7.8 | 25 | Yes | Good | Good |
| B2 | 23.3 | 13.1 | 0.022 | 37.5 | 0.18 | Yes | 6.9 | 32 | Yes | Good | Good |
| B3 | 17.5 | 9.2 | 0.052 | 152.0 | 0.25 | Yes | 11.3 | 19 | Yes | Good | Good |
| B4 | 18.7 | 9.9 | 0.053 | 36.9 | 0.24 | Yes | 7.8 | 25 | Yes | Good | Good |
| B5 | 22.8 | 13.7 | 0.042 | 79.0 | 0.27 | Yes | 7.9 | 33 | Yes | Good | Good |
| B6 | 17.5 | 8.4 | 0.007 | 61.1 | 0.23 | Yes | 12.6 | 26 | Yes | Good | Good |

TABLE 8

S15C Control Examples
Components and Test Results

| No. | S/O | Ca S $\times 10^{-5}$ | Ca/S | TiZrN $\times 10^{-6}$ | O/N | SI Area | MnS Numb. | DSI Area | Pro. Film | Mach | Chip Brk. |
|---|---|---|---|---|---|---|---|---|---|---|---|
| b1 | 7.1 | 0.2 | 0.007 | — | 0.19 | No | 1.7 | 3 | No | Poor | Poor |
| b2 | 47.9 | 30.9 | 0.037 | 117.0 | 0.14 | No | 8.1 | 14 | Yes/ No | Poor | Good |
| b3 | 22.3 | 15.1 | 0.019 | — | 0.36 | Yes | 3.2 | 48 | Yes | Good | Poor |

TABLE 9

S55C Working Examples
Alloy Compositions (wt. %, balance Fe)

| No. | C | Si | Mn | P | S | Al | O | N | Ca | Others |
|---|---|---|---|---|---|---|---|---|---|---|
| C1 | 0.55 | 0.29 | 0.88 | 0.020 | 0.024 | 0.010 | 0.0011 | 0.0105 | 0.0011 | Ti0.0057<br>Cr0.15<br>Mo0.01 |
| C2 | 0.55 | 0.34 | 1.02 | 0.017 | 0.080 | 0.011 | 0.0020 | 0.0099 | 0.0021 | Ti0.0035<br>Cr0.15<br>Mo0.01 |
| C3 | 0.54 | 0.39 | 0.95 | 0.015 | 0.044 | 0.008 | 0.0024 | 0.0102 | 0.0019 | Ti0.0077<br>Cr0.11<br>Mo0.01 |
| C4 | 0.55 | 0.31 | 0.95 | 0.018 | 0.045 | 0.011 | 0.0017 | 0.0108 | 0.0018 | Ti0.018<br>Cr0.13<br>Mo0.01 |
| C5 | 0.55 | 0.34 | 0.89 | 0.015 | 0.041 | 0.010 | 0.0015 | 0.0105 | 0.0013 | Zr0.0035<br>Cr0.13<br>Mo0.01 |
| C6 | 0.55 | 0.32 | 0.93 | 0.017 | 0.039 | 0.010 | 0.0018 | 0.0103 | 0.0016 | Ti0.0100<br>Zr0.0025<br>Cr0.13<br>Mo0.01 |

TABLE 10

S55C Control Examples
Alloy Compositions (wt. %, balance Fe)

| No. | C | Si | Mn | P | S | Al | O | N | Ca | Others |
|---|---|---|---|---|---|---|---|---|---|---|
| c1 | 0.56 | 0.83 | 0.99 | 0.015 | 0.017 | 0.029 | 0.0027 | 0.0001 | 0.0001 | Ti0.0029<br>Cr0.15<br>Mo0.01 |
| c2 | 0.56 | 0.37 | 0.86 | 0.022 | 0.452 | 0.161 | 0.0010 | 0.0089 | 0.0023 | Cr0.10<br>Mo0.01 |
| c3 | 0.54 | 0.47 | 0.77 | 0.011 | 0.111 | 0.008 | 0.0034 | 0.0101 | 0.0031 | Cr0.11<br>Mo0.01 |

TABLE 11

S55C Working Examples
Components and Test Results

| No. | S/O | Ca S $\times 10^{-5}$ | Ca/S | TiZrN $\times 10^{-6}$ | O/N | SI Area | MnS Numb. | DSI Area | Pro. Film | Mach | Chip Brk. |
|---|---|---|---|---|---|---|---|---|---|---|---|
| C1 | 21.8 | 2.6 | 0.046 | 59.9 | 0.10 | Yes | 7.2 | 37 | Yes | Good | Good |
| C2 | 40.0 | 16.8 | 0.026 | 34.7 | 0.20 | Yes | 9.6 | 25 | Yes | Good | Good |
| C3 | 18.3 | 8.4 | 0.043 | 78.5 | 0.24 | Yes | 10.8 | 21 | Yes | Good | Good |
| C4 | 26.5 | 8.6 | 0.040 | 194.4 | 0.16 | Yes | 5.7 | 24 | Yes | Good | Good |
| C5 | 27.3 | 5.3 | 0.032 | 36.8 | 0.14 | Yes | 6.4 | 30 | Yes | Good | Good |
| C6 | 21.7 | 6.2 | 0.041 | 36.1 | 0.17 | Yes | 8.8 | 27 | Yes | Good | Good |

TABLE 12

S55C Control Examples
Components and Test Results

| No. | S/O | Ca S $\times 10^{-5}$ | Ca/S | TiZrN $\times 10^{-6}$ | O/N | SI Area | MnS Numb. | DSI Area | Pro. Film | Mach | Chip Brk. |
|---|---|---|---|---|---|---|---|---|---|---|---|
| c1 | 6.3 | 0.2 | 0.006 | 29.6 | 0.26 | No | 11.6 | 4 | No | Poor | Good |
| c2 | 452.0 | 104.0 | 0.005 | — | 0.11 | Yes | 3.1 | 6 | No | Poor | Poor |
| c3 | 32.6 | 34.4 | 0.028 | — | 0.34 | Yes | 2.3 | 56 | Yes | Good | Poor |

TABLE 13

SCR415 Working Examples
Alloy Compositions (wt. %, balance Fe)

| No. | C | Si | Mn | P | S | Al | O | N | Ca | Others |
|---|---|---|---|---|---|---|---|---|---|---|
| D1 | 0.15 | 0.26 | 0.55 | 0.018 | 0.019 | 0.019 | 0.0022 | 0.0084 | 0.0028 | Ti0.0031<br>Cr0.19<br>Mo0.01<br>Mg0.0021 |
| D2 | 0.16 | 0.08 | 0.73 | 0.022 | 0.031 | 0.021 | 0.0014 | 0.0151 | 0.0019 | Ti0.0049<br>Zr0.003<br>Cr3.21<br>Mo0.01 |
| D3 | 0.15 | 0.25 | 0.80 | 0.014 | 0.070 | 0.006 | 0.0029 | 0.0144 | 0.0024 | Ti0.0075<br>Cr1.20<br>Mo0.02 |
| D4 | 0.15 | 0.21 | 0.65 | 0.016 | 0.044 | 0.011 | 0.0020 | 0.0108 | 0.0018 | Ti0.0180<br>Cr2.13<br>Mo0.01 |
| D5 | 0.15 | 0.24 | 0.79 | 0.015 | 0.041 | 0.010 | 0.0017 | 0.0115 | 0.0015 | Zr0.0035<br>Cr3.13<br>Mo0.01 |
| D6 | 0.16 | 0.22 | 0.63 | 0.017 | 0.039 | 0.015 | 0.0018 | 0.0123 | 0.0016 | Ti0.0100<br>Zr0.0027 |

TABLE 13-continued

| SCR415 Working Examples Alloy Compositions (wt. %, balance Fe) | | | | | | | | | | |
|---|---|---|---|---|---|---|---|---|---|---|
| No. | C | Si | Mn | P | S | Al | O | N | Ca | Others |
| | | | | | | | | | | Cr0.15<br>Mo0.01 |

TABLE 14

| SCR415 Control Examples Alloy Compositions (wt. %, balance Fe) | | | | | | | | | | |
|---|---|---|---|---|---|---|---|---|---|---|
| No. | C | Si | Mn | P | S | Al | O | N | Ca | Others |
| d1 | 0.15 | 0.27 | 0.82 | 0.011 | 0.025 | 0.025 | 0.0045 | 0.0090 | 0.0001 | Cr0.15<br>Mo0.01 |
| d2 | 0.15 | 0.07 | 0.66 | 0.018 | 0.071 | 0.071 | 0.0007 | 0.0149 | 0.0023 | Ti0.0050<br>Cr0.10<br>Mo0.01 |
| d3 | 0.15 | 0.25 | 0.65 | 0.015 | 0.051 | 0.051 | 0.0024 | 0.0181 | 0.0031 | Cr0.011<br>Mo0.01 |

TABLE 15

| SCR415 Working Examples and Control Examples Components and Test Results | | | | | | | | | | | |
|---|---|---|---|---|---|---|---|---|---|---|---|
| No. | S/O | Ca S $\times 10^{-5}$ | Ca/S | TiZrN $\times 10^{-6}$ | O/N | SI Area | MnS Numb. | DSI Area | Pro. Film | Mach | Chip Brk. |
| D1 | 8.6 | 5.3 | 0.147 | 26.0 | 0.26 | Yes | 13.1 | 18 | Yes | Good | Good |
| D2 | 22.1 | 5.9 | 0.061 | 119.3 | 0.09 | Yes | 5.6 | 33 | Yes | Good | Good |
| D3 | 24.1 | 16.8 | 0.034 | 108.0 | 0.20 | Yes | 8.1 | 27 | Yes | Good | Good |
| D4 | 22.2 | 7.9 | 0.041 | 194.4 | 0.19 | Yes | 6.3 | 31 | Yes | Good | Good |
| D5 | 24.1 | 6.2 | 0.037 | 40.3 | 0.16 | Yes | 9.6 | 28 | Yes | Good | Good |
| D6 | 21.7 | 6.2 | 0.041 | 45.5 | 0.15 | Yes | 10.2 | 25 | Yes | Good | Good |

TABLE 16

| SCR415 Control Examples Components and Test Results | | | | | | | | | | | |
|---|---|---|---|---|---|---|---|---|---|---|---|
| No. | S/O | Ca S $\times 10^{-5}$ | Ca/S | TiZrN $\times 10^{-6}$ | O/N | SI Area | MnS No. | DSI | Film | Mach | Chip |
| d1 | 5.6 | 6.3 | 0.100 | — | 0.50 | No | 4.6 | 15 | Yes/ No | Poor | Poor |
| d2 | 101.4 | 5.0 | 0.010 | 74.5 | 0.05 | No | 3.9 | 9 | No | Poor | Poor |
| d3 | 21.3 | 10.2 | 0.039 | — | 0.13 | Yes | 2.2 | 47 | Yes | Good | Poor |

TABLE 17

| SCM440 Working Examples Alloy Compositions (wt. %, balance Fe) | | | | | | | | | | |
|---|---|---|---|---|---|---|---|---|---|---|
| No. | C | Si | Mn | P | S | Al | O | N | Ca | Others |
| E1 | 0.41 | 0.30 | 0.77 | 0.023 | 0.020 | 0.002 | 0.0019 | 0.0112 | 0.0015 | Ti0.0030<br>Cr1.02<br>Mo0.10 |
| E2 | 0.39 | 0.20 | 0.74 | 0.022 | 0.080 | 0.008 | 0.0028 | 0.0125 | 0.0019 | Ti0.0034<br>Cr0.99<br>Mo0.14 |

TABLE 17-continued

SCM440 Working Examples
Alloy Compositions (wt. %, balance Fe)

| No. | C | Si | Mn | P | S | Al | O | N | Ca | Others |
|---|---|---|---|---|---|---|---|---|---|---|
| E3 | 0.43 | 0.23 | 0.35 | 0.015 | 0.101 | 0.006 | 0.0032 | 0.0120 | 0.0031 | Ti0.0029<br>Cr1.34<br>Mo0.75<br>REM0.0054 |
| E4 | 0.44 | 0.30 | 0.65 | 0.015 | 0.045 | 0.007 | 0.0025 | 0.0117 | 0.0022 | Ti0.0057<br>Cr1.45<br>Mo0.15 |
| E5 | 0.41 | 0.21 | 0.75 | 0.015 | 0.045 | 0.012 | 0.0030 | 0.0107 | 0.0017 | Ti0.0170<br>Cr2.13<br>Mo0.01 |
| E6 | 0.43 | 0.23 | 0.71 | 0.019 | 0.040 | 0.010 | 0.0027 | 0.0115 | 0.0015 | Zr0.0036<br>Cr3.13<br>Mo0.01 |
| E7 | 0.41 | 0.25 | 0.63 | 0.016 | 0.037 | 0.009 | 0.0018 | 0.0113 | 0.0019 | Ti0.0110<br>Zr0.0026<br>Cr0.15<br>Mo0.01 |

TABLE 18

SCM440 Control Examples
Alloy Compositions (wt. %, balance Fe)

| No. | C | Si | Mn | P | S | Al | O | N | Ca | Others |
|---|---|---|---|---|---|---|---|---|---|---|
| e1 | 0.44 | 0.19 | 0.75 | 0.010 | 0.015 | 0.010 | 0.0022 | 0.0107 | 0.0019 | Cr1.10<br>Mo0.12 |
| e2 | 0.41 | 0.40 | 0.44 | 0.022 | 0.207 | 0.008 | 0.0022 | 0.0141 | 0.0025 | Cr2.07<br>Mo0.51 |
| e3 | 0.39 | 0.40 | 0.25 | 0.031 | 0.030 | 0.020 | 0.0012 | 0.0190 | 0.0077 | Ti0.0044<br>Cr1.45<br>Mo0.79 |
| e4 | 0.39 | 0.21 | 0.60 | 0.023 | 0.049 | 0.010 | 0.0020 | 0.0062 | 0.0021 | Cr1.11<br>Mo.015 |

40

TABLE 19

SCM440 Working Examples
Components and Test Results

| No. | S/O | Ca S $\times 10^{-5}$ | Ca/S | TiZrN $\times 10^{-6}$ | O/N | SI Area | MnS Numb. | DSI Area | Pro. Film | Mach | Chip Brk. |
|---|---|---|---|---|---|---|---|---|---|---|---|
| E1 | 10.5 | 3.0 | 0.075 | 33.6 | 0.26 | Yes | 8.7 | 19 | Yes | Good | Good |
| E2 | 28.6 | 15.2 | 0.024 | 42.5 | 0.22 | Yes | 9.6 | 27 | Yes | Good | Good |
| E3 | 31.6 | 31.3 | 0.031 | 34.8 | 0.27 | Yes | 11.3 | 18 | Yes | Good | Good |
| E4 | 18.0 | 9.9 | 0.049 | 66.7 | 0.21 | Yes | 5.8 | 33 | Yes | Good | Good |
| E5 | 15.0 | 7.7 | 0.038 | 181.9 | 0.28 | Yes | 12.1 | 16 | Yes | Good | Good |
| E6 | 14.8 | 6.0 | 0.038 | 41.4 | 0.23 | Yes | 11.6 | 22 | Yes | Good | Good |
| E7 | 20.6 | 7.0 | 0.051 | 41.8 | 0.16 | Yes | 6.3 | 36 | Yes | Good | Good |

TABLE 20

SCM440 Control Examples
Components and Test Results

| No. | S/O | Ca S $\times 10^{-5}$ | Ca/S | TiZrN $\times 10^{-6}$ | O/N | SI Area | MnS Numb. | DSI Area | Pro. Film | Mach | Chip Brk. |
|---|---|---|---|---|---|---|---|---|---|---|---|
| e1 | 6.8 | 2.9 | 0.127 | — | 0.21 | No | 3.3 | 7 | Yes/No | Poor | Poor |

TABLE 20-continued

SCM440 Control Examples
Components and Test Results

| No. | S/O | Ca S $\times 10^{-5}$ | Ca/S | TiZrN $\times 10^{-6}$ | O/N | SI Area | MnS Numb. | DSI Area | Pro. Film | Mach | Chip Brk. |
|---|---|---|---|---|---|---|---|---|---|---|---|
| e2 | 94.1 | 51.8 | 0.012 | — | 1.42 | Yes | 2.3 | 11 | Yes/ No | Poor | Poor |
| e3 | 25.0 | 23.1 | 0.257 | 83.6 | 0.06 | No | 4.2 | 12 | No | Poor | Poor |
| e4 | 24.5 | 10.3 | 0.043 | — | 0.32 | Yes | 1.8 | 49 | Yes | Good | Poor |

What is claimed is:

1. A steel for machine structural use having good machinability and chip-breakability, which consists essentially of, by wt. %, C: 0.05–0.8%, Si: 0.01–2.0%, Mn: 0.1–3.5%, S: 0.01–0.2%, Al: 0.001–0.020%, Ca: 0.0005–0.02%, O: 0.0005–0.01% and N: 0.001–0.04%, and further, one or both of Ti: 0.002–0.010% and Zr: 0.002–0.025%, the balance being Fe and inevitable impurities, and is characterized in that the area in microscopic field occupied by the sulfide inclusion particles containing Ca of 1–45 wt. % and neighboring to oxide inclusion particles containing CaO of 0.2–62 wt. % and having melting point of 1500–1750° C. is $2.0\times10^{-4}$ $mm^2$ per 3.5 $mm^2$ or more, and that the sulfide inclusion particles other than the above defined sulfide inclusion particles are finely dispersed as MnS in the steel.

2. The steel for machine structural use according to claim 1, wherein the number of the finely dispersed MnS inclusion particles having averaged diameter of 1.0 $\mu$m or more is 5 particles/$mm^2$ per 0.01% of S-content.

3. The steel for machine structural use according to claim 2, wherein the area occupied by the finely dispersed MnS inclusion particles having averaged diameter of 1.0 $\mu$m or more shares 60–85% of the microscopic field and the area occupied by the sulfide inclusion particles containing Ca of 1–45 wt. % and neighboring to oxide inclusion particles containing CaO of 0.2–62 wt. % and having melting point of 1500–1750° C. shares 40–15%.

4. The steel for machine structural use according to claim 1, wherein the ratio [O]/[N] in the alloy composition is 0.06 or more.

5. The steel for machine structural use according to claim 1, wherein the steel further contains, in addition to the alloy components set forth in claim 1, one or more of Cr: up to 3.5%, Mo: up to 2.0%, Cu: up to 2.0%, Ni: up to 4.0%, B: 0.0005–0.01% and Mg: up to 0.2%.

6. The steel for machine structural use according to claim 1, wherein the steel further contains, in addition to the alloy components set forth in claim 1, one or both of Nb: up to 0.2% and V: up to 0.5%.

7. The steel for machine structural use according to claim 1, wherein the steel further contains, in addition to the alloy components set forth in claim 1, one or more of Pb: up to 0.4%, Se: up to 0.4% and Te: up to 0.2%.

8. A method of producing the steel for machine structural use having good machinability and chip-breakability set forth in claim 1, comprising the steps of preparing an alloy consisting essentially of, by wt. %, C: 0.05–0.8%, Si: 0.01–2.0%, Mn: 0.1–3.5%, S: 0.01–0.2%, Al: 0.001–0.020%, Ca: 0.0005–0.02%, O: 0.0005–0.01% and N: 0.001–0.04%, the balance being Fe and inevitable impurities, by melting and refining process for the conventional steel making, in which controlled deoxidization is conducted under the following conditions:

[S]/[O]: 8–40

$[Ca]\times[S]$: $1\times10^{-5-1\times10-3}$

[Ca]/[S]: 0.01–20 and so as to adjust the area percentage of the sulfide inclusion particles containing Ca of 1–45 wt. % and neighboring to oxide inclusion particles containing CaO of 0.2–62 wt. % and having melting point of 1500–1750° C. to $2.0\times10^{-4}$ $mm^2$ per 3.5 $mm^2$ or more of the microscopic field, and thereafter, adding one or both of Ti: 0.002–0.010% and Zr: 0.002–0.025% so as to form fine Ti-oxide and/or Zr-oxide by reaction of oxygen with Ti and/or Zr in the steel after the above controlled deoxidization, and to utilize the resulting complex oxide particles as the nuclei for precipitation and fine dispersion of MnS inclusion particles.

9. The method of producing the steel for machine structural use having good machinability and chip-breakability according to claim 8 wherein the steel for machine structural use with improved fatigue strength and bend-straightenability is produced by regulating the averaged particles sizes of Ti(C,N) and TiO by adjusting the amounts of Ti, N and O at the time of adding Ti to meet the following conditions:

$[Ti]\times[N]$: $5\times10^{-6-2\times10-4}$

[O]/[N]: 0.06 or more so as to secure the amount of MnS for fine precipitation and dispersion with TiO as nuclei, and by maintaining the former austenite crystal grain size fine during hot processing.

* * * * *